US005300740A

United States Patent [19]

Benda

[11] Patent Number: 5,300,740

[45] Date of Patent: Apr. 5, 1994

[54] CIRCUIT BREAKER LOCK OUT - MULTI-POLE

[76] Inventor: Steven J. Benda, 13657 10th St. Southwest, Cokato, Minn. 55321

[21] Appl. No.: 52,993

[22] Filed: Apr. 27, 1993

[51] Int. Cl.[5] ..... H01H 27/10

[52] U.S. Cl. ..... 200/43.14; 200/43.15

[58] Field of Search ..... 335/8-10; 200/43.14, 43.15, 50 R, 50 C

[56] References Cited

U.S. PATENT DOCUMENTS 3,214,530 10/1965 Tharp et al. ..... 200/43.15

4,006,324 2/1977 Leasher et al. ..... 200/43.14

4,677,261 6/1987 Nourry ..... 200/43.15

5,079,390 1/1992 Costanzo et al. ..... 200/50 R

*Primary Examiner*—Lincoln Donovan

*Attorney, Agent, or Firm*—Paul H. Gallagher

[57] ABSTRACT

Separate parts slidably fitted together, that have opposed and interfacing cavity surfaces forming a cavity therebetween. The device is fitted to ganged switches, with the switch levers, and tie bar, positioned in the cavity. a screw draws the parts together, with the cavity surfaces that form the cavity, gripping the switch levers and bar therebetween.

16 Claims, 3 Drawing Sheets

CIRCUIT BREAKER LOCK OUT - MULTI-POLE

CROSS REFERENCE

My prior and copending application Ser. No. 07/813,341 filed Dec. 24, 1991.

BRIEF SUMMARY OF THE INVENTION

The invention resides in the broad field of controlling circuit breakers in an electrical system. In the control of an electrical system, it is often desired to block out certain circuit breakers to de-energize corresponding circuits, when work is to be done in or around the circuits. In such electrical circuit systems, very often a plurality of circuit breakers are utilized in a single location. Sometimes it is desired to block out only a single circuit breaker, but many times it is desired to block out more than one. The present invention is directed to the latter situation, where circuit breakers are so disposed next to each other, and it is desired to block out for example two such juxtaposed circuit breakers. The device of the present invention is constructed and operable for blocking out two adjacent circuit breakers, and is known as a multi-pole lock out.

In this field circuit breakers are often also referred to as switches. They include control levers or tongues that are manually actuated for throwing the switches between ON and OFF positions. The device disclosed and claimed in my prior patent application identified above, is also a multi-pole device, but the device of the present invention differs from that prior device in that the present device includes what may be characterized as a body made up of a pair of main parts, and is applied to the switch by fitting those main parts together in such a position that they mechanically grip and hold the levers in position.

In devices of this general nature, a cavity is provided for receiving the control levers of the circuit breakers, and a broad object of the invention is to provide such a device which includes a single such cavity that accommodates all sizes of control levers, within a wide range.

Another broad object of the invention is to provide a device of the above general character, in which the parts have opposed cavity surfaces that are movable toward each other to form the cavity, and they grip the switch actuating lever and securely hold them in a blocked out position. The cavity is actually reduced in size in this action, from a beginning maximum size progressively to a smaller size for gripping the actuating levers.

A further advantage of the invention is that a single device may be placed in either of opposite positions corresponding to opposite ON and OFF positions, eliminating the need for a plurality of different lock outs for the different positions of the actuating lever.

Another advantage of the invention relates to a certain standard item utilized in multi-pole arrangements. In the customary control of two adjacent circuit breakers, a tie bar is utilized, secured to the actuating levers of the two circuit breakers. This tie bar stretches across the space between the levers, and forms a hole or space between itself and the upper surface of the circuit breakers. Heretofore it has been customary, in the use of various kinds of lock outs, to use a tie wrap to tie the lock out device to the tie bar, as added security against removing the lock out from the circuit breakers. The advantage of the present invention, related to this situation, is that the device eliminates the need for such a tie wrap, since the securement of the device to the circuit breakers is strong and effective, without such a tie wrap.

A more specific object of the invention is to provide an advantage in effective securement to the circuit breakers, in that adjustable means, such as a threaded screw, is utilized for tightening the parts of the main body against the control levers, such securement being increased as the securing means is drawn up.

A still further object is to provide a lock out of the foregoing nature, having an additional feature of a novel arrangement for applying an extraneous lock, such as a padlock.

BRIEF DESCRIPTION OF THE INDIVIDUAL FIGURES OF THE DRAWINGS

DETAIL DESCRIPTION

Figure 3:
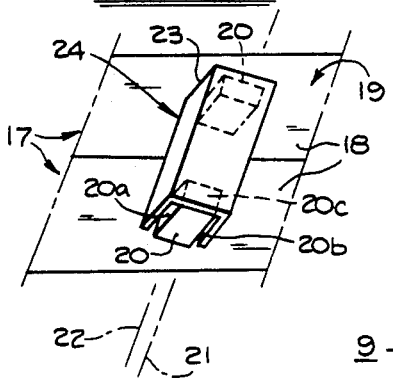
FIG. 3 is a perspective view of certain elements of two switches, and a standard tie bar, of which the device of the present invention is particularly applicable.

Before entering into a detail description of the device itself, it is desired to make reference to the circuit breakers, or switches, with which the device is to be used. For this purpose attention is directed to FIG. 3 which shows a plurality of switches, two in this case, that are to be controlled together in a gang, i.e., as distinguished from a single switch. As mentioned above, many times it is desired that when one portion of a circuit controlled by one switch, is out of commission, associated switches must be opened or disabled. FIG. 3 shows two such switches 17 placed together. Each switch has an individual front panel 18, and when the switches are so placed, the individual front panels lie in a common main front panel 19. The switches have actuating levers or tongues 20 extending through the individual front panels, and are on a common longitudinal line 21, and are swingable on an axis 22 parallel with the line 21 and disposed adjacent the main front panel. The switch levers have side surfaces 20*a*, 20*b*, and end surfaces 20*c*. A tie bar 23 of known kind is shown somewhat diagrammatically, and basically is in the form of an inverted channel fitted over the actuating levers of the adjacent switches, and is held or locked thereon in a known manner not pertinent in the present instance. The tie bar when so utilized is spaced from the main front panel, and it thereby provides a space or opening 24 which is utilized as a locking hole between itself and the switches. In the use of the device of the present invention, a locking lug is positioned in that space, as will be brought out in detail hereinbelow.

The terms lock out and block out are sometimes used interchangeably in this field, in referring to devices of this kind, although lock out is used generally herein.

Figure 1:
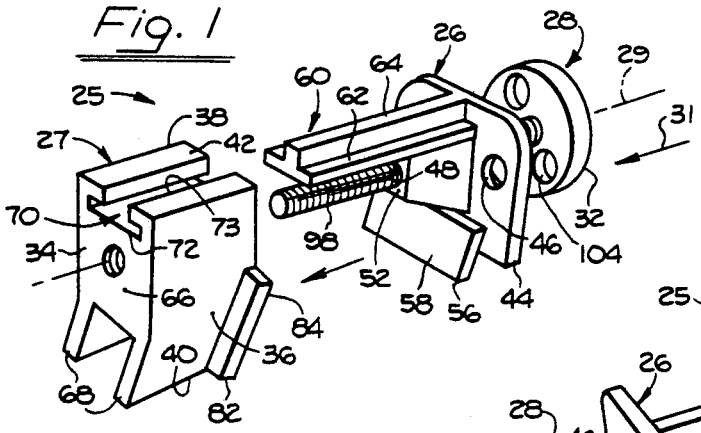
FIG. 1 is a perspective view of the device of the present invention with the parts in separated position.
Figure 2:
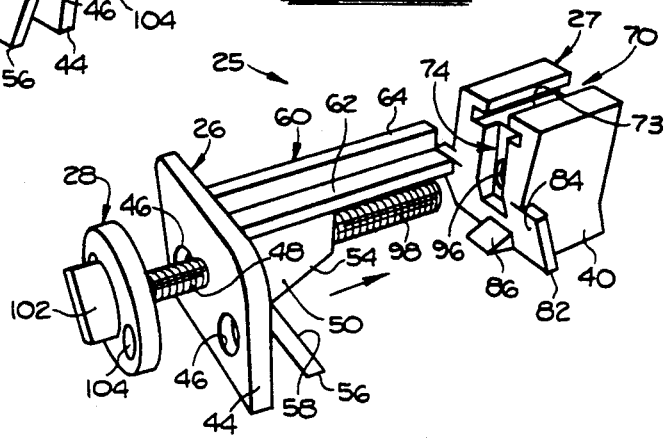
FIG. 2 is a perspective view from an angle generally opposite that of FIG. 1.

Referring in detail to the construction of the lock out device of the invention it is shown in its entirety at 25 and includes three parts 26, 27, 28. The following description is based on the device being oriented as shown in FIGS. 1 and 2, but it may be used in other positions, and in such other positions the description is to be interpreted accordingly. For convenience the device is considered as having a longitudinal direction as indicated by the axis 29, and has a front end as observed in the position of the arrow 31. The device thus has a front end 32, a rear end 34, and left side 36, and a right side 38. The device as oriented as referred to, has a bottom surface 40 which lies in, or substantially in, a plane and has a top side 42.

The parts 26, 27 form front and rear parts, separate from each other, as illustrated, and are fitted together to form a unitary body or member, being secured together by the screw 28, and drawn up tight thereby in gripping position on the switch lever as referred to again hereinbelow.

Referring to the specific mechanical construction of the parts 26, 27, each of these is a separate molded piece. They are of suitable plastic material, of presently known kind.

The front part 26, includes a front element 44 having a broad front surface, and determining the width of the device. This front element is plate-like in shape and has side holes 46 for receiving an extraneous locking element as referred to hereinbelow. The front part also has a longitudinal central hole 48 for receiving the screw 28 in a sliding fit.

The front part 26, rearwardly of the front element 44 includes a vertical central piece 50, of substantial thickness, and through which the hole 48 extends. This piece 50 has a rear vertical surface 52, leading downwardly into a diagonal surface 54 which forms the top surface of the cavity to be formed, for receiving the switch lever as referred to hereinbelow. The piece 50 continues downwardly integral with the front element 44, and has a bottom surface 55 lying in the bottom surface 40 of the device as a whole. The part 26 also includes a plate element 56 of substantial width and inclined to the vertical. This plate 56 has a rear surface 58 which constitutes one side of the cavity referred to, and it is pointed out that this cavity surface is disposed at an angle relative to the inclined surface 54, preferably at a right angle, although this particular angular relationship is not critical.

The front part 26 also includes a top element 60 constituting a slide of inverted T-shape, including a horizontal element 62 and a vertical top element. This slide 60 is of substantial length, sufficient to extend substantially through the rear part 27, in horizontal direction, when the device is applied to the switch.

The rear part 27 includes a main or central solid portion 66 and side legs 68 terminating downwardly in the bottom surface 40. At the top the rear part has an inverted T-shape slot 70, forming a guide, extending longitudinally therethrough, having a lower wide portion 72 opening upwardly at 73, for slidingly receiving the slide 60.

Figure 4:
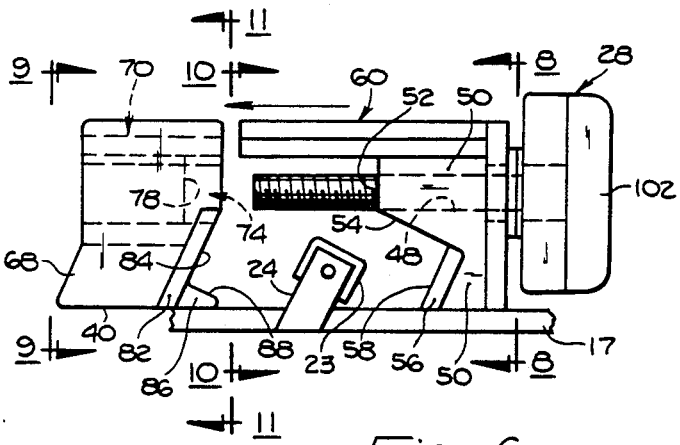
FIG. 4 is a side view of the device in extended position, fitted to the switch levers.

The rear part 27 (FIG. 4), in its front surface has a forwardly facing vertical recess or groove 74 having an inner or bottom surface 78. This recess is dimensioned for receiving the vertical central piece 50 of the front part.

The rear part 27 has a front element 82 with a front cavity surface 84 which constitutes the opposite side of the cavity from the cavity surface 58, this element 82 having a transverse dimension similar to the element 56. At the bottom of the cavity surface 84 is a bottom lug or toe 86 extending generally forwardly and having an inclined upper surface 88. The cavity surfaces 84, 58 are preferably substantially parallel, and therefore substantially perpendicular to the top inclined 54 which becomes the top of the cavity. The relationship between the various elements of the two parts will be referred to again hereinbelow.

The cavity referred to now identified as 85 (FIGS. 5 and 6) is formed by the three surfaces 54, 58, 84, and the cavity as indicated by its central axis 90 is inclined at an acute angle 92 to the horizontal. This relationship is of significance in applying the device to the switch, and it is pointed out that bottom lug 86 extends from the cavity surface 84 into the cavity in the acute angle 92, as opposed to the external obtuse angle 94.

The rear part 27 has a longitudinal hole 96 therethrough internally threaded, and in applying the device to the switches, the screw 28 is slid through the hole 48 and then threaded into the hole 96 for drawing the parts up together.

Figure 14:
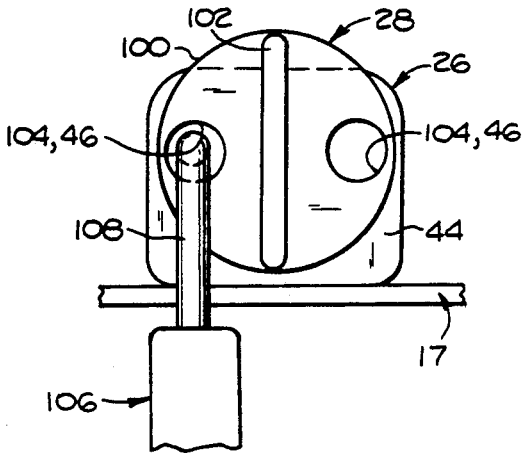
FIG. 14 is a view taken from the left of FIG. 13.
Figure 13:
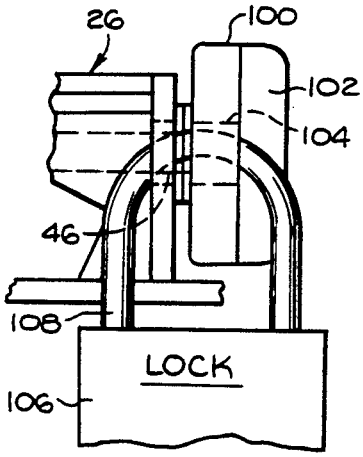
FIG. 13 is a view of the right hand end portion of FIG. 4 showing a padlock applied thereto.

The screw 28 may be made of any suitable material, such as for example having a metal threaded stem 98, and a head 100 of any suitable material, such as plastic. Preferably the head has a diametrical gripping blade 102, and side holes 104 which register with the side holes 46 in the front element 44, when the screw is turned up to appropriate position. In so applying the device to the switch, the two parts are drawn up tight, and as a security against unwarranted removal of the device from the switches, an extraneous lock 106, (FIGS. 13, 14), such as a padlock is utilized. The locking element 108 of the padlock is inserted through aligned holes 104, 46, and locked, preventing removal of the screw.

This arrangement of elements in the screw and front part, for locking, provide an advantage in positioning the padlock. In this situation, the padlock, when applied to the device and hanging therefrom, as illustrated, lies substantially in a vertical plane parallel with the longitudinal axis 29 of the device, serving as a convenience in handling the device and the padlock. It will be noted that the padlock in this case is positioned at the side, as contrasted with being positioned at the front. This arrangement is contrasted with devices known heretofore in which such padlock is positioned at the front of the device, and disposed in a transverse direction.

Figure 5:
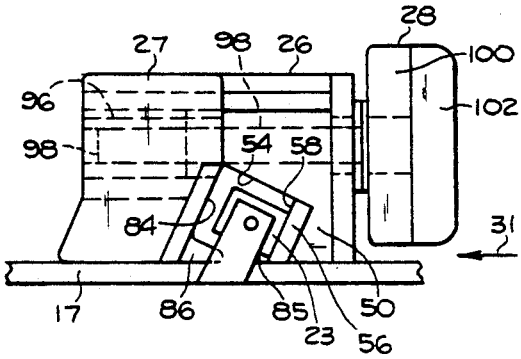
FIG. 5 is a view similar to FIG. 4 but partially drawn up to gripping position.
Figure 6:
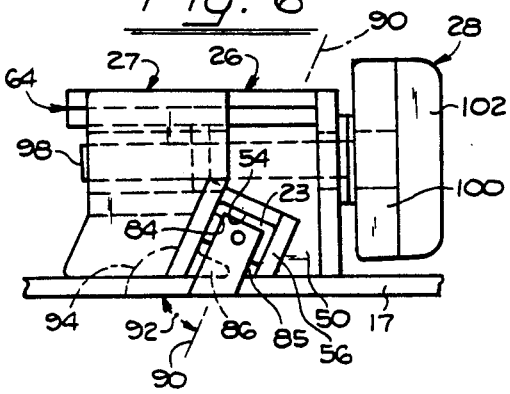
FIG. 6 is a view similar to FIGS. 4 and 5, but with the device fully drawn up.
Figure 7:
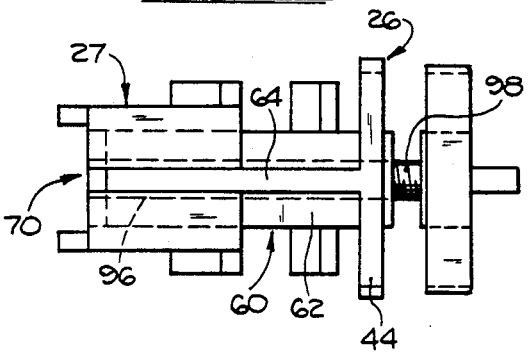
FIG. 7 is a top view of the device.
Figure 8:
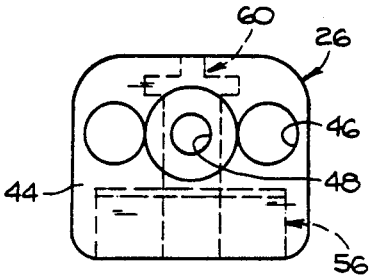
FIG. 8 is an end view of the body of the device, taken at line 8—8 of FIG. 4.
Figure 9:
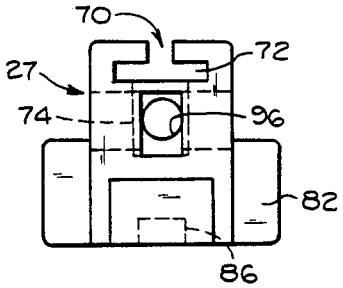
FIG. 9 is an end view taken at line 9—9 of FIG. 4.
Figure 10:
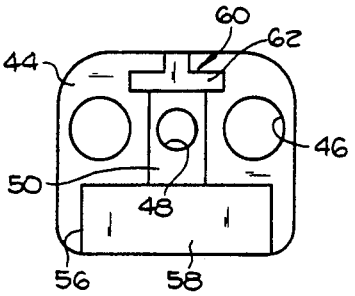
FIG. 10 is a view taken at line 10—10 of FIG. 4.
Figure 11:
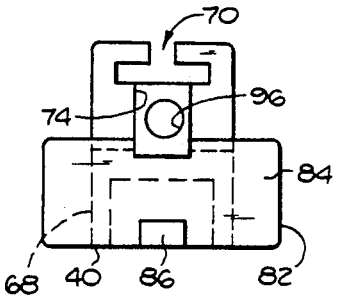
FIG. 11 is a view taken at line 11—11 of FIG. 4.
Figure 12:
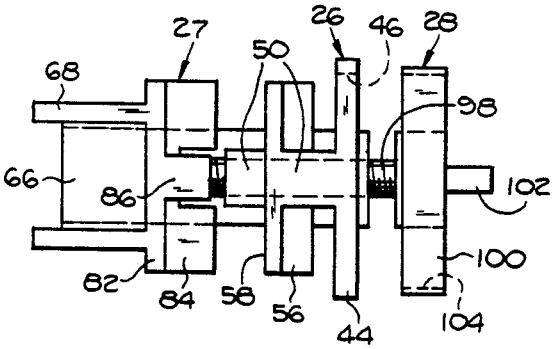
FIG. 12 is a bottom view.

In applying the device to the switches, the front and rear parts are fitted together with the slide 60 fitted in the guide or slot 70, loosely. For this purpose the screw 28 may be withdrawn, or at least backed off. In such position, the two parts are fitted over the switch levers and tie bar (FIG. 3), the latter being received in the cavity 85 formed by the two parts (FIG. 5). In the initial handling of the parts, they are spaced apart such that the cavity is not yet actually formed, but as they are pushed toward each other, the cavity surfaces 58, 84 move toward each other, and the central piece 50 enters into the recess 74. At this point the two cavity surfaces mentioned, are on opposite sides of the switch lever, and the inclined surface 54 together with those cavity surfaces form the cavity that opens downwardly. As the two parts are moved toward each other, they are merely slid by hand, as a convenience, and when they are moved up to engage the switch levers, the screw then is turned up to mechanically draw the parts tight against the switch levers. Although the cavity surfaces 58, 84 actually engage the tie bar, it may be considered that they engage the actuating levers themselves, and for convenience it may be stated that they engage the tie bar/switch levers.

The cavity actually changes in dimensions, that is, the three cavity surfaces 54, 58, 84 are actually drawn inwardly, reducing the dimensions of the cavity. The two surfaces 58, 84 are moved toward each other, and as the vertical piece 50 moves into the recess, it moves in a direction parallel with the bottom surface, and thus the top inclined surface 54 as an entirety moves along a line parallel to that surface. Because of the inclination of the top surface, the higher portion moves into the recess, and the lower portion, progressively, moves, relative to the surface 84, toward the opposite side of the cavity, and the lower portion is closer to the bottom surface and thus the cavity is reduced in height. Therefore the cavity is reduced in both dimensions, horizontally and vertically, as the two main parts 26, 27, are drawn up, toward each other.

As indicated above, the bottom lug 86 is inserted under the tie bar and it is in position to produce a positive engagement therewith, preventing the device from being withdrawn from the switches. As a feature separate from this positive engagement, and as in the case of the device of my prior application identified above, the different elements of the device engage both the switch levers and the top surfaces of the circuit breakers, and in this way also produce a binding effect that restrains the device from being removed from the circuit breaker.

As is well known, in circuit breakers of this general type, the switch lever in each of the ON and OFF positions, is at an acute angle, and the cavity 85 in the lock out is at substantially the same acute angle. Most often the switches are locked out in OFF position, and the lock out device is applied thereto in corresponding position. However, if it should be desired to lock it out in ON position, then the device is merely turned end for end and applied to the switch in the same manner.

Because the cavity in the device is of variable size, i.e., as the parts are drawn together, a single lock out device is applicable to switches of different sizes, thus eliminating the need for a plurality of lock out devices of different sizes for different size switches. This feature is of great significance also in connection with the tie bar which is of greater thickness than the switch levers themselves, and the main parts of the device can be drawn up against the tie bar with great effectiveness. The locking and blocking actions produce great effect, because of the great mechanical gripping action of the cavity surfaces against the tie bar, and thus against the levers. The elements of the device that actually engage the tie bar are part of a relatively massive construction, minimizing, if not actually eliminating, likelihood to breaking or weakening of the parts that directly grip the switches.

The arrangement whereby the cavity surfaces are bodily moved into engagement with the switch elements, eliminates the requirement, as in previous devices, for a filler element to be applied to the switch levers in the cases where the cavities were of relatively indeterminate size, although usually greater in size than the switch levers, because of predetermined design relative to the related parts, and thus the drawing up of the cavity surfaces, as in the present case, overcomes any inaccuracies in predetermining the size of the cavity.

An important feature of the device is the two parts 26, 27, constituting nearly the whole portion of the mechanical construction. These parts are somewhat block-like in structure, and correspondingly relatively massive, and thereby produce a strong gripping effect. The use of the screw 28 for drawing up the parts 26, 27 produces a very strong mechanical action, and eliminates the need for extraneous tools, and the tie wrap of my previous application identified above.

The device also is very adaptable to incorporation of yieldable material for additional gripping effect on switch levers. For such feature attention is directed to FIG. 15. In this construction, a yieldable lining 110 is applied to the cavity surfaces. This lining is of rubber-like character, and preferably of plastic material chemically compatible with the plastic material of the device itself, and thermally bondable therewith. The method of dual durometer high pressure injection, which is well known, may be utilized in applying this lining. In drawing up the parts of the device, this lining 110 grips the switch levers and because of the yieldable character thereof, produces a better gripping action and adapts well to switch levers of different sizes, with the additional feature that if any uncontrolled different sizes occur, in the switch levers, they are accommodated by this material. It is also practical to provide recess formations 112 adjacent the inner end of the cavity for receiving corresponding enlargements on the switch lever, for producing a greater gripping effect. If desired the material 110 can also be applied to the top cavity surface 54, as indicated at 114.

Figure 15:
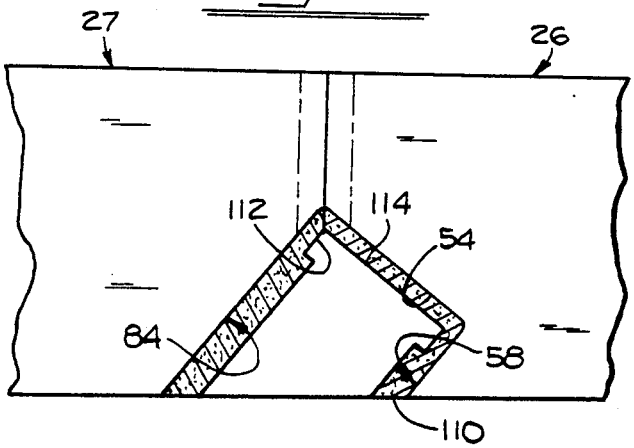
FIG. 15 is a view similar to the central portion of FIG. 6 and showing an additional feature.
Figure 16:
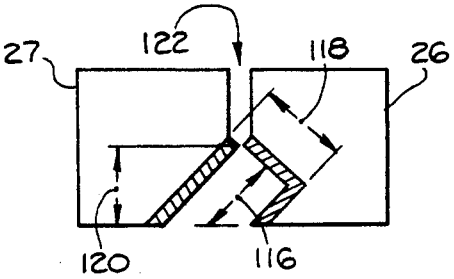
FIG. 16 is a diagrammatic view, similar to FIG. 15, showing the parts in a different position.
Figure 17:
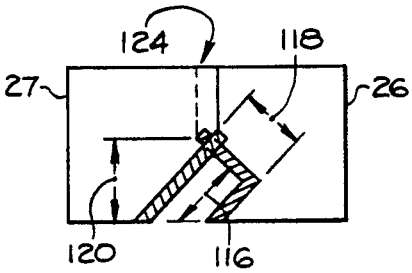
FIG. 17 is a view similar to FIG. 16 showing the parts in a still different position.

FIGS. 15, 16 and 17 show different sizes of cavities; these figures being devoid of details, for convenience. In FIG. 15 the cavity is of medium size in which the interfacing edges of the parts are coincident. In FIG. 16, those edges are spaced apart, forming a larger cavity, and in FIG. 17, they overlap and form a smaller cavity. In these figures, the cavities are considered to have a depth or length 116, and a width or transverse dimension 118. They also have a vertical dimension 120. Thus, the depth and transverse dimensions vary, as does the vertical dimension 120.

I claim:

1. A lock out device for use with ganged switches having individual front panels lying in a common main front panel, the switches having actuating levers exposed through the main front panel, together positioned on a longitudinal line, and swingable on an axis adjacent to the main front panel and parallel with said longitudinal line, between opposite positions spaced apart angularly, and a tie bar secured to the levers for producing conjoint swinging movement of the levers in the manner stated, there being a hole under the tie bar and between the switch levers, said lock out device comprising, a body having a longitudinal direction, and including front and rear parts, the parts being separate from each other and being mounted together for longitudinal relative sliding movement, the parts having opposed transverse upright cavity surfaces which, when the parts are so mounted together, form a cavity opening through the bottom surface of the body, the body, consisting of the parts so mounted together, being fitted to the switches in locking position in which the bottom surface engages said main panel and at least a portion of the tie bar is received in the cavity, and the lock out device including securing means for mechanically adjustably drawing the parts together with the cavity surfaces in locking engagement with the tie bar.

2. A lock out device according to claim 1 wherein, one of the parts has a locking lug at the bottom of its said cavity surface, that, when the parts are so mounted together and the body is in locking position, extends longitudinally into the cavity and under the tie bar.

3. A lock out device according to claim 1 for use with ganged switches of the kind mentioned, and further in which the actuating levers when in either of the said opposite positions are disposed at an acute angle to the main front panel, wherein, the cavity extends from the bottom surface at the same said acute angle.

4. A lock out device according to claim 3 wherein, the locking lug is positioned on that side of the cavity where the external angle between the cavity and the bottom surface is obtuse.

5. A lock out device according to claim 1, wherein the tie bar levers have side surfaces, and the opposed cavity surfaces engage the side surfaces of the tie bar/levers.

6. A lock out device according to claim 3 wherein, the upright cavity surfaces determine the angle of the cavity, and one of the parts has a top cavity surface substantially perpendicular to the upright cavity surfaces.

7. A lock out device according to claim 6 wherein, the top cavity surface is positioned with a lower end at the part on which it is mounted and an opposite upper end, whereby as the parts are moved toward each other, and as the upright cavity surfaces consequently move toward each and reduce the longitudinal dimension of the cavity, a progressively lower portion of the top cavity surface is presented to the cavity and thereby reduces the vertical dimension of the cavity.

8. A lock out device according to claim 1 wherein, one of the parts has a longitudinally extending slide and the other part has a longitudinally extending guide slidingly receiving the slide, and the securing means is operable for drawing the parts together in longitudinal direction.

9. A lock out device according to claim 8 wherein, the securing means includes a screw extending through the parts, slidable in one of the parts and threaded in the other.

10. A lock out device according to claim 9 wherein, the front part has a front element having a broad transverse front surface, the screw includes a head positioned adjacent said front surface and extending a substantial distance thereacross, and the screw head having holes adjacent its periphery, and the front element having holes adjacent its side edges, the holes being axially aligned at times upon turning the screw, and being adapted to receive extraneous locking means.

11. A lock out device according to claim 1 wherein, each of the parts includes elements forming a block-like form, and each includes an integral element extending transversely and forming the corresponding upright cavity surface.

12. A lock out device according to claim 7 wherein, the front part has a central vertical element of substantial width that forms the top cavity surface, the rear part has a vertical groove for receiving said vertical element, the vertical groove has an inner surface engageable by said vertical element and thereby serving as a stop means for limiting the movement of the parts together, and the securing means is constituted by a screw extended horizontally through said vertical element and an aligned portion of the rear part.

13. A lock out according to claim 1 wherein, each of the front and rear parts is an integral article of molded plastic.

14. A lock out device according to claim 13 wherein, the material making up said front and rear parts is relatively rigid, and the upright cavity surfaces are covered by a lining of relatively yieldable material.

15. A lock out device according to claim 14 wherein, said lining is provided with recesses for receiving correlated shaped elements on the tie bar/levers.

16. A lock out according to claim 14 wherein, the lining is also of plastic material, and said front and rear parts, and the lining, are formed by high pressure injection.

* * * * *